United States Patent [19]

Moreland

[11] 4,325,149

[45] Apr. 20, 1982

[54] AIR SUPPLY SYSTEM FOR SPAS

[75] Inventor: Gerald W. Moreland, Garden Grove, Calif.

[73] Assignee: Hydro Air Industries, Inc., Orange, Calif.

[21] Appl. No.: 156,668

[22] Filed: Jun. 5, 1980

[51] Int. Cl.[3] ..... A61H 9/00; E04H 3/20; A47K 3/10; F04D 29/40

[52] U.S. Cl. ..... 4/488; 4/492; 4/542; 415/219 C

[58] Field of Search ..... 4/538, 507, 540–544, 4/567–569, 488, 492, 494, 496, 615, 509, 490; 55/467, 470–473, 468; 261/30; 415/121.6, 168, 170 A, 219 C; 417/36, 38; 128/66

[56] References Cited

U.S. PATENT DOCUMENTS

| | | | |
|---|---|---|---|
| 2,571,513 | 10/1951 | Ammerman | 415/219 C |
| 2,793,640 | 5/1957 | Schwartz | 128/66 |
| 3,267,936 | 8/1966 | Brady | 128/66 |
| 3,286,712 | 11/1966 | Roden | 4/544 X |
| 3,710,786 | 1/1973 | Rico et al. | 128/66 |
| 3,750,656 | 8/1973 | Vaughan | 128/66 |
| 3,978,886 | 9/1976 | Mathis | 4/492 X |
| 4,083,705 | 4/1978 | Parise et al. | 55/467 X |

OTHER PUBLICATIONS

*Spa and Sauna* Trade Journal, Published Apr. 1980, pp. 65, 58.

*Primary Examiner*—Stuart S. Levy
*Attorney, Agent, or Firm*—Knobbe, Martens, Olson, Hubbard & Bear

[57] ABSTRACT

An air supply system for spas provides protection against motor short circuits caused by water backflowing through the air supply line to the housing containing the motor and blower. A moisture-proof partition isolates the motor from direct exposure to the air supply line. The partition and the blower air intake tube are arranged to prevent water from reaching the motor, unless such water first flows through the outlet ports of the blower and then through the blower air intake tube. The blower ports dissipate the water backflow pressure, thereby preventing backflow surges of short duration from reaching the motor. In addition, the inlet end of the air intake tube extends vertically well above the bottom of the motor to provide a static head to offset the backflow pressure of water in the air intake tube.

In an alternative embodiment, a drain is provided by ducting the air intake tube to the exterior of the housing to positively prevent water from reaching the motor.

13 Claims, 3 Drawing Figures

AIR SUPPLY SYSTEM FOR SPAS

BACKGROUND OF THE INVENTION

This invention relates to systems for supplying compressed air to spas and pools.

These air supply systems comprise a housing containing a motor and blower. In the prior art systems, the blower is typically of an axial impeller type, which is mounted above the motor. Air is drawn into the axial opening of the blower and is discharged downward through the motor, thereby providing air cooling for the motor. In such manner, the blower, driven by the motor, supplies compressed air to an air supply line, connected on one end to the motor/blower housing and on the other end to the spa. The compressed air is discharged through numerous small apertures in the wall of the spa, below the water level, thereby creating an effervescent effect.

In the prior art, the motor is located in a part of the housing which is in open communication with the air supply line. As a result, problems may arise when the air supply system is turned off. Since the air supply line is below the water level of the spa, water can flow back into this line. The momentum of the water may carry it beyond the air supply line to the housing, thereby risking water contact with the motor, and, thus, creating a hazard of shock and possible electrocution to the spa user.

These hazards are even more significant for spas equipped with water/air jets. In these installations, a water pump forces water through a pipe connected to the spa wall, thereby creating a water jet effect in the spa. However, it is often desirable to increase the turbulence of the existing water by introducing air into the water pipe near its outlet end. The air is typically supplied by a venturi which draws air into the water jet, but the turbulence may be increased by supplying the air under pressure from the same blower and motor used to produce the aforesaid effervescent effect.

Problems with these water/air jet systems occur if the spa user blocks the jet with his hand or other part of his body. Since the water is typically supplied at higher pressure than the air, the blockage may force water back through the air supply line to housing containing the blower and motor. Consequently, the motor is exposed to risk of short circuit. Since the spa user is necessarily in the water when this situation occurs, the short circuit creates an extreme danger of shock or electrocution.

The prior art has endeavored to minimize these dangers by use of check valves in the air line, and by raising the motor/blower housing, thereby increasing its height relative to the water level of the spa. These measures are somewhat successful in preventing the back flow of water into the motor/blower housing after the air supply has been turned off. They are less effective where the spa user has blocked the flow of the water/air jet. Their lack of effectiveness is due primarily to malfunctioning of the check valves, and to the aesthetic difficulties associated with increasing the height or the motor/-blower housing. As a consequence, the prior art air supply systems expose spa users to a significant risk of shock and electrocution.

Another problem associated with the prior art relates to deterioration of the motors due to excessive humidity. Since the housing containing the blower and motor, or a pipe in open communication with this housing, can fill with water, the motor and associated electrical parts are exposed to dampness and moisture, even if the water level in the housing does not reach the motor. This moisture causes the motors to prematurely deteriorate, thereby increasing spa maintenance problems.

SUMMARY OF THE INVENTION

The preferred embodiment of the present invention alleviates these and other difficulties of the prior art by providing means for separating the motor and blower with a waterproof partition, so that only the blower, which is electrically insulated from the motor, is subjected to water back flow and evaporation. The invention also provides an equipment configuration in which the motor is above the blower and partition, effectively increasing the height of the motor relative to the water level, without raising the level of the housing itself relative to the ground. In addition, the invention provides means for restricting the back flow of water, without restricting the forward flow of air. In alternative embodiments, the present invention prevents any contact of water with the motor by providing means for draining water reaching the motor/blower housing before such water can contact the motor.

In the preferred embodiment, a motor/blower housing is divided into two chambers, a motor chamber and an air pressure chamber, with the former being above the latter. This division is accomplished by means of a horizontal moisture-proof partition, which divides the housing roughly in half. A motor is mounted on the moisture-proof partition in the motor chamber, and a blower is mounted on the moisture-proof partition directly beneath the motor in the air pressure chamber. A sealed aperture is included in the moisture-proof partition to permit mechanical connection of the motor and the blower, while prohibiting moisture from passing therethrough.

An air intake passage or inlet duct provides ambient air to the blower. On one end, the air intake passage is connected to an air intake aperture on the bottom of the blower. The other end of the air intake passage extends vertically through the aperture in the moisture-proof partition and terminates in the motor chamber above such partition but below the top of the housing. The aperture in the moisture-proof partition is sized and sealed to permit the air intake passage to fit through it while prohibiting moisture from passing directly from the air pressure chamber to the motor chamber.

An air supply line or outlet duct is connected to the air pressure chamber on one end and to a spa on the other end, thereby providing means for transmitting air to the spa.

The preferred embodiment addresses the problem of motor short circuits caused by water backflowing into the motor/blower housing by separating the motor from the blower with said moisture-proof partition in the manner previously described. Thus, water cannot enter the motor chamber and, therefore, cannot short circuit the motor except by successively flooding the air pressure chamber, the blower, and the air intake passage. However, if such flooding occurs, water can enter the blower only through small air output blower ports. Thus, the momentum of water backflowing into the motor/blower housing will be dissipated as it flows through the small blower ports. Therefore, the momentum of such water cannot, by itself, cause flooding of the motor chamber.

If, however, the water backflow is continuous and under pressure, the water will eventually fill the blower and the air intake passage. But the water will not flood the motor chamber unless the back pressure is sufficient to force it above the top of the air intake passage. Thus, the distance that the air intake passage extends above the bottom of the motor represents an increased head which must be overcome by the back pressure in order for the motor chamber to flood. In such manner, the present invention provides increased protection against motor short circuits.

Further, the present invention provides increased protection against motor deterioration due to excessive moisture. Since, as previously mentioned, the motor is essentially separated from contact with the air pressure chamber, the motor is protected against dampness or moisture caused by water back flow or evaporation from the air supply line. In contrast, the prior art provides very limited protection for the motor against such dampness or moisture. In such manner, the present invention prolongs the life of the motor and thereby reduces spa maintenance.

The preferred embodiment also includes means for cooling the motor with ambient air drawn over the motor by the blower. Such cooling is provided by terminating the air intake passage in the motor chamber, thereby allowing ambient air to be drawn into the chamber and across the motor.

An alternative embodiment includes means for draining water reaching the motor/blower housing before such water can contact the motor, thereby completely protecting the motor from water or moisture. This is accomplished by horizontally ducting the intake end of the air intake passage through an aperture in the wall of the motor/blower housing. Thus, if the air intake passage fills with water, such water will drain though the wall of the motor/blower housing and fall harmlessly to the ground.

The alternative embodiment may be modified by providing an aperture at the top of the air intake passage at the point where such passage is horizontally ducted through the wall of the motor/blower housing. Such aperture allows air to be drawn into the air intake passage through the motor chamber, as well as from outside the motor/blower housing, thereby providing a continuous supply of ambient air to cool the motor while providing a drain to protect the motor from moisture.

DESCRIPTION OF THE DRAWINGS

These and other advantages of the present invention are best understood through reference to the drawings in which.

DETAILED DESCRIPTION OF THE PREFERRED EMBODIMENT

Figure 1:
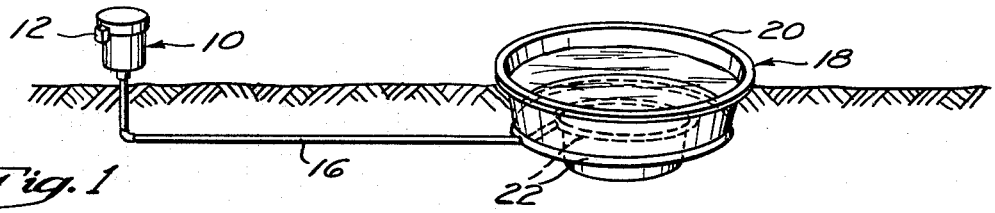
FIG. 1 is a perspective view of an air supply system for spas which illustrates the relationship among: the present invention; the air supply line; and the spa.

Referring initially to FIG. 1, the present invention 10 is connected to a spa 18 by an air supply line 16. Power is supplied to the present invention 10 through a junction box 12. The present invention 10 supplies compressed air through the line 16 to air discharge lines 22 contained within a spa shell 20 of the spa 18. As will be obvious to those skilled in the art, the present invention 10 can be used for other applications such as supplying air under pressure to spa water/air jets.

Figure 2:
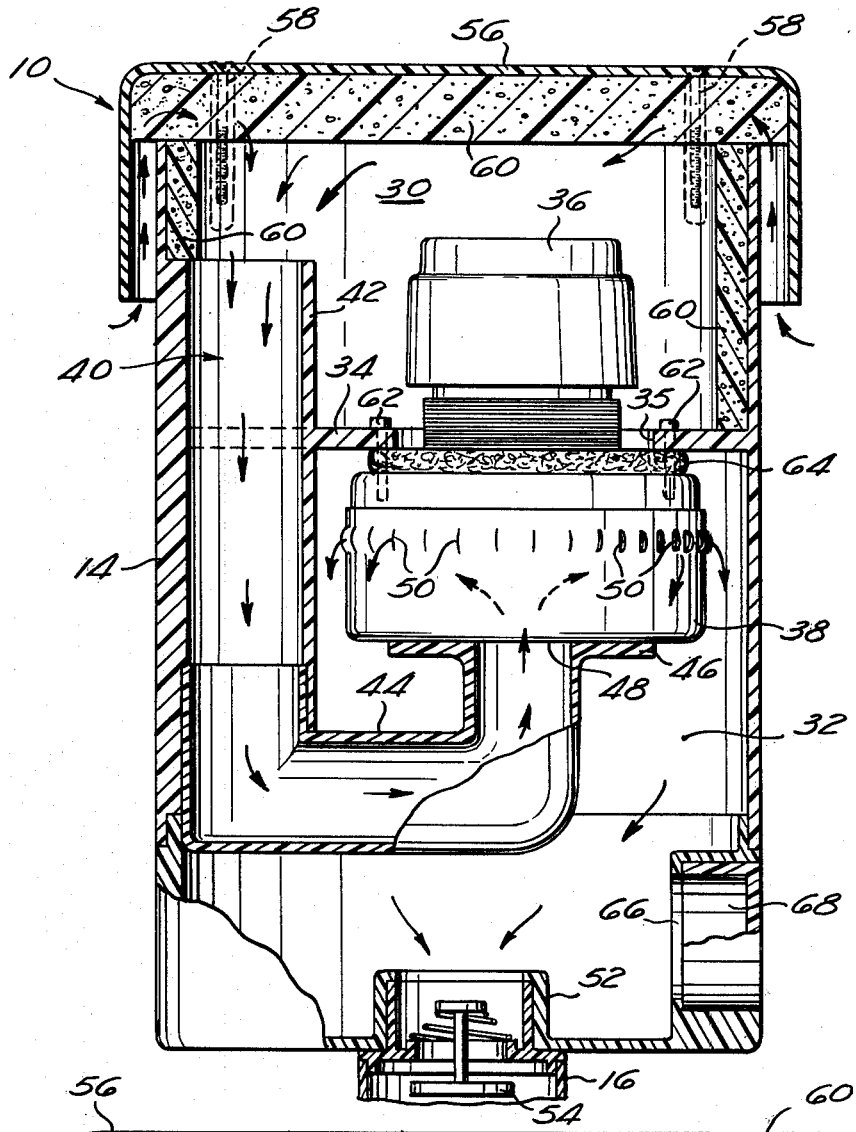
FIG. 2 is an elevation, mostly in section, of the preferred embodiment of the present invention.

Referring now to FIG. 2, the operation of the preferred embodiment of the present invention will be described. A housing 14 is divided into an upper motor chamber 30 and a lower air pressure chamber 32 by a horizontal moisture-proof partition 34. A motor 36 is mounted on the partition 34 within the motor chamber 30. A blower comprising a blower housing 38 and a centrifugal impeller (not shown) is driven by the motor 36. The blower is electrically insulated from the motor 36 and is mounted on the partition 34, directly beneath the motor 36, in the air pressure chamber 32. An air intake passage 40 formed by tubes 42, 44 and a flange 46, is connected to an air intake aperture 48 of the blower housing 38. The tube 42 of the passage 40 extends through the partition 34 and terminates in the motor chamber 30, substantially above the partition 34. The blower draws ambient air through a filter, which will be subsequently described, into the motor chamber 30, and through the air intake passage 40 to the blower housing 38 where the air is compressed by the centrifugal impeller (not shown) and discharged through blower ports 50 to the air pressure chamber 32. The air then flows from the air pressure chamber 32 to the spa 18 (FIG. 1) by means of the air supply line 16, which is connected to the housing 14 at a fitting 52.

A check valve 54 is provided at the fitting 52 to prevent water from back-flowing through the line 16 to the housing 14. If, however, the check valve 54 malfunctions and allows water into the housing 14, the moisture-proof partition 34 will prevent such water from splashing on the motor 36. Indeed, the partition 34 makes it impossible for water to contact the motor 36 unless the quantity of water entering the housing 14 is of such volume that its level reaches the blower ports 50. If this occurs, the blower housing 38 and the air intake passage 40 would become flooded. However, because the blower ports 50 are relatively small, the force of any water entering them would be dissipated. Therefore, water cannot reach the motor chamber 30 unless the back flow pressure is of sufficient magnitude and duration so as to cause such water to reach the top of the air intake passage 40. Further, since the tube 42 of the air intake passage 40 extends well above the partition 34, such back flow pressure would need to be sufficiently great to overcome the head created by such extension. Thus, a back flow of relatively short duration, even at high pressure, will not cause the motor chamber 30 to flood because of the pressure dissipating effect of the blower ports 50. Likewise, a back flow at relatively low pressure, even for long durations, will not cause the motor chamber 30 to flood because of the increased head provided by the tube 42 of the air intake passage 40.

In such manner, the motor 36 is protected against water back flowing into the housing 14, as well as from any dampness of moisture that may enter the housing 14 through supply line 16.

The motor 36 is protected against rain and debris entering the top of the housing 14 by a housing cover 56, which is connected to the housing 14 by bolts 58. The bottom of the housing cover 56 and the sides of the motor chamber 30 are lined with a filter material 60 to soundproof the motor chamber as well as filter air entering the motor chamber 30. Air is drawn into the motor chamber through the annular opening formed by the housing 14 with the housing cover 56. The air is filtered through the insulating material 60 and is drawn across the motor 56 to the air intake passage 40, thereby providing a supply of clean ambient air to cool the motor 36.

The motor 36 and the blower are connected through an aperture 35 and are fastened to the moisture-proof partition 34 by bolts 62. A gasket 64 is included to provide a moisture-proof seal between the blower housing 38 and the moisture-proof partition 34.

A variety of sizes of blower housings 38 can be accommodated without changing the size of the tube 42 or the housing 14 simply by modifying the tube 44 and the flange 46.

In addition to the air supply line fitting 52 located at the bottom of the housing 14, the preferred embodiment also includes a second air supply line fitting 66 located on the side of the housing 14 to permit an alternative or auxiliary connection for the air supply line 16. A plug 68 is provided so that the fittings 52 and 66 can be selectively plugged.

As previously mentioned, the motor chamber 30 of the preferred embodiment will flood when the water back flow pressure causes water to reach the top of the tube 42 of the air intake passage 40. To prevent this from occurring, an alternative embodiment provides for draining such water out of the passage 40 to the exterior of the housing 14.

Figure 3:
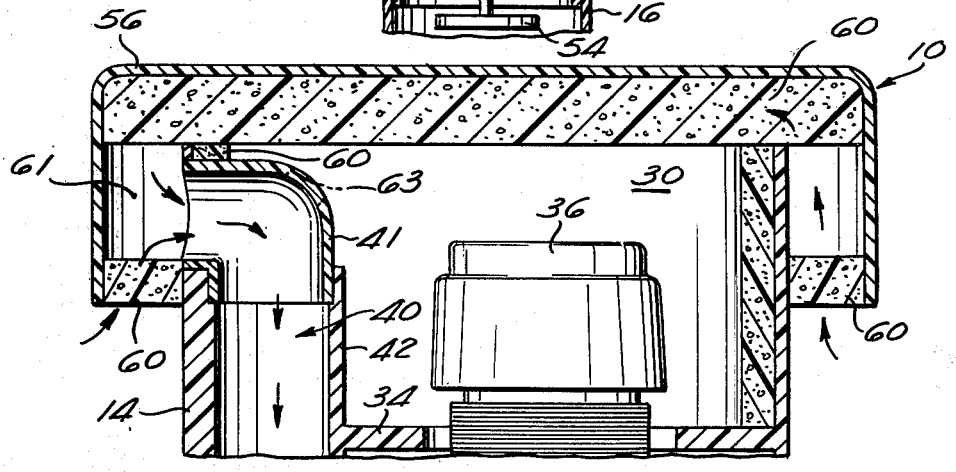
FIG. 3 is a similar sectional view of the alternative embodiment which illustrates the difference between such embodiment and the preferred embodiment.

Referring to FIG. 3, the alternative embodiment is identical to the preferred embodiment except that the air intake passage 40 is modified and the filter material 60 is relocated. Such modification of the air intake passage 40 is accomplished by providing an elbow 41 connected on one end to the top of the tube 42. The other end of the elbow 41 is extended horizontally through an aperture in the housing 14, thereby providing a drain for any water reaching the top of the tube 42. The filter material 60 is relocated between the housing 14 and the vertical portion of the housing cover 56 to provide an annular air intake passage 61. Air is drawn into the passage 61 through the ring of filter material 60 to filter air drawn into the air intake passage 40. If water fills the air intake passage 40, it will drain out of the tube 41 through the ring of filter material 60 to the ground. While, in this alternative embodiment, the tube 41 is extended through the housing 14 above the filter material 60 to allow filtering the intake air, it will be obvious to those skilled in the art that the air intake passage 40 could be similarly extended through the housing 14 at various other locations.

Thus, the alternative embodiment provides positive protection for the motor 36 from the water back flow, and associated moisture and dampness.

Unlike the preferred embodiment, however, the alternative embodiment does not draw air into the air intake passage 40 from the motor chamber 30. Rather, the entire supply of intake air is drawn directly from outside the housing 14. This difference between the two embodiments can best be understood by comparing the air intake passage 40 of FIGS. 2 and 3. In FIG. 2, the air intake passage 40 terminates in the motor chamber 30, thereby allowing ambient air to be drawn into the motor chamber 30, and across the motor 36 to provide cooling for the motor 36. However, in FIG. 3, the air intake passage 40 is ducted through the housing 14, and therefore, the passage 40 does not draw ambient air into the motor chamber 30 to cool the motor 36. Thus, depending on the heat generating and heat dissipating properties of the individual motor used, it may be desirable to modify the alternative embodiment to allow some ambient air to be drawn into the motor chamber 30 to cool the motor 36. This can be accomplished by providing an aperture 63 at the top of the elbow 41 of the intake passage 40, as shown by the dotted lines in FIG. 3. The aperture allows the air intake passage 40 to draw a small amount of air from the motor chamber 30, while drawing the majority of the pumped air from outside the housing 14. Because the lower surface of the elbow 41, at which drainage of water can occur, is below the aperture 63, water will drain from the air intake passage 40 before reaching the aperture 63 to prevent water contact with the motor 36.

What is claimed is:

1. Apparatus for supplying air, under pressure, to aerate water in a spa, comprising:

a housing, comprising:

an air pressure chamber;

a motor chamber; and a moistureproof partition separating said motor chamber from said air pressure chamber to prohibit moisture from passing directly from said air pressure chamber to said motor chamber;

a blower mounted in said air pressure chamber, said blower comprising a fan enclosed within a blower housing, said blower housing communicating with said air pressure chamber only through flow constricting orifices to supply air under pressure thereto, the inlet of said blower located in said air pressure chamber;

an air inlet duct, connected to supply air to said blower inlet from a location outside of said housing, said air inlet duct communicating with said air pressure chamber solely through said blower inlet and said blower, and sealed from said air pressure chamber to prevent water in said air pressure chamber from entering said air inlet duct without passing through said blower housing an air outlet duct, connecting said air pressure chamber to said spa;

a motor mounted in said motor chamber;

means for connecting said motor to drive said blower, said connecting means passing through an aperture in said partition; and means for sealing said air pressure chamber from said motor chamber at said aperture.

2. Apparatus for supplying air to spas, as defined in claim 1, wherein said air inlet duct passes through an opening in said partition to draw air through said motor chamber from said location outside of said housing, said inlet duct sealed to said opening to prevent direct communication between said motor chamber and said air pressure chamber.

3. Apparatus for supplying air to spas, as defined in claim 1, additionally comprising filter means for filtering ambient air drawn through said inlet duct from said location outside of said housing.

4. Apparatus for supplying air to spas, as defined in claim 1, wherein said motor chamber is located above said air pressure chamber.

5. Apparatus for supplying air to spas, as defined in claim 1, wherein said air pressure chamber additionally comprises:

a first outlet fitting on the bottom of said air pressure chamber;

a second outlet fitting on one side of said air pressure chamber;

said first and second outlet fittings being sized to permit selective connection of said air outlet duct to either one of said fittings; and means for selectively plugging the other one of said fittings.

6. Apparatus for supplying air to spas, as defined in claim 1, wherein said inlet duct extends through said moisture-proof partition.

7. Apparatus for supplying air to spas, as defined in claim 1, wherein said air inlet duct additionally comprises:

a first air intake port into said air inlet duct, located in said motor chamber to permit air to be drawn into said air inlet duct from said motor chamber;

a second air intake port into said air inlet duct, located at the exterior of said housing to permit air to be drawn into said air inlet duct from outside said housing;

said second port being at a lower elevation than said first port.

8. Apparatus as defined in claim 1 wherein said fan is a centrifugal impeller fan.

9. Apparatus as defined in claim 1 wherein said blower comprises means for dissipating the pressure of water backflowing from said spa before said water can reach said motor chamber.

10. Apparatus as defined in claim 1 wherein said air inlet duct comprises means for draining water which backflows from said spa to prevent said water from contacting said motor.

11. Apparatus for supplying air, under pressure, to aerate water in a spa, comprising:

a housing, comprising:

an air pressure chamber;

a motor chamber; and a moisture proof partition separating said motor chamber from said air pressure chamber to prohibit moisture from passing directly from said air pressure chamber to said motor chamber;

a blower mounted in said air pressure chamber, said blower comprising:

a fan; and a blower housing containing said fan, the walls of said blower housing being sealed from said air pressure chamber except for small apertures for providing communication between the interior of said blower housing and said air pressure chamber such that said fan blows air through said apertures into said air pressure chamber;

an inlet to said blower, said inlet located in said air pressure chamber;

an air inlet duct, connected to supply air to said blower inlet from a location outside of said housing, said air inlet duct communicating with said air pressure chamber solely through said blower inlet and said blower, and sealed from said air pressure chamber to prevent water in said air pressure chamber from entering said air inlet duct without passing through said blower housing said air inlet duct passing through an opening in said partition to draw air from said location outside of said housing, said inlet duct sealed to said opening to prevent direct communication between said air pressure chamber and said motor chamber.

12. Apparatus for supplying air, under pressure, to aerate water in a spa, comprising:

a housing, comprising:

an air pressure chamber;

a motor chamber; and a moisture proof partition separating said air pressure chamber from said motor chamber to prohibit moisture from passing directly from said air pressure chamber to said motor chamber;

a blower, mounted within said air pressure chamber, said blower comprising a fan enclosed within a blower housing, said blower housing communicating with said air pressure chamber only through flow constricting orifices to supply air under pressure thereto, the inlet of said blower located in said air pressure chamber;

an air inlet duct, connected to supply air to said blower inlet from a location outside of said housing, said air inlet duct communicating with said air pressure chamber solely through said blower inlet and said blower, and sealed from said air pressure chamber to prevent water in said air presure chamber from entering said air inlet duct without passing through said blower housing an air outlet duct, connecting said air pressure chamber to said spa, said air pressure chamber being subject to water flooding;

a motor, mounted in said motor chamber, said motor sealed from direct communication with said air pressure chamber;

means for connecting said motor to said blower, said connecting means passing through an aperture in said partition; and means for sealing said air pressure chamber from said motor chamber at said aperture.

13. Apparatus for supplying air, under pressure, to aerate water in a spa, comprising:

a housing, comprising:

an air pressure chamber;

a motor chamber, located above said air pressure chamber; and a moisture proof partition separating said air pressure chamber from said motor chamber to prohibit moisture from passing directly from said air pressure chamber to said motor chamber;

a blower mounted in said air pressure chamber, said blower comprising:

a fan;

a blower housing containing said fan, the walls of said blower housing having small apertures for providing communication between the interior of said blower housing and said air pressure chamber, such that said fan blows air through said apertures into said air pressure chamber; and an inlet to said blower, said inlet located in said air pressure chamber;

an air inlet duct, connected to supply air to said blower inlet from a location outside of said housing, said air inlet duct communicating with said air pressure chamber solely through said blower inlet and said blower;

said air inlet duct passing through an opening in said partition to draw air from said location outside of said housing, said inlet duct sealed to said opening to prevent direct communication between said air pressure chamber and said motor chamber through said opening;

a motor, mounted in said motor chamber;

means for connecting said motor to said blower to drive said blower, said connecting means passing through and aperture in said moisture proof partition; and means for sealing said air pressure chamber from said motor chamber at said aperture.

* * * * *